US006568188B2

(12) United States Patent
Kolman et al.

(10) Patent No.: US 6,568,188 B2
(45) Date of Patent: May 27, 2003

(54) BYPASS AIR INJECTION METHOD AND APPARATUS FOR GAS TURBINES

(75) Inventors: Kevin Michael Kolman, Clifton Park, NY (US); James Michael Storey, Albany, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/205,228

(22) Filed: Jul. 26, 2002

(65) Prior Publication Data

US 2002/0184871 A1 Dec. 12, 2002

Related U.S. Application Data

(62) Division of application No. 09/828,471, filed on Apr. 9, 2001, now Pat. No. 6,449,956.

(51) Int. Cl.[7] ..... F02C 1/00
(52) U.S. Cl. ..... 60/760; 60/39.23; 60/732
(58) Field of Search ..... 60/722, 39.23, 60/760, 732

(56) References Cited

U.S. PATENT DOCUMENTS

| | | | | |
|---|---|---|---|---|
| 4,047,877 A | | 9/1977 | Flanagan | |
| 4,255,927 A | * | 3/1981 | Johnson et al. | 60/39.23 |
| 5,207,053 A | | 5/1993 | Spadaccini et al. | |
| 5,351,474 A | * | 10/1994 | Slocum et al. | 60/39.23 |
| 5,461,864 A | | 10/1995 | Betta et al. | |
| 5,924,276 A | * | 7/1999 | Mowill | 60/39.23 |
| 6,289,667 B1 | | 9/2001 | Kolaczkowski et al. | |
| 6,302,683 B1 | | 10/2001 | Vestin et al. | |

* cited by examiner

*Primary Examiner*—Ehud Gartenberg
(74) *Attorney, Agent, or Firm*—Nixon & Vanderhye P.C.

(57) ABSTRACT

A bypass air injection scheme for a combustor of a gas turbine. Combustor includes a body with an inner liner and a casing enclosing the body with a passageway defined therebetween. A predetermined amount of the compressor discharge air passing through the passageway is extracted through a manifold. A conduit feeds the extracted air into an injection manifold having a plurality of injection tubes for injecting the extracted air into the combustor bypassing the reactor. The injection tubes and the injection manifold are disposed in a substantially common axial plane.

9 Claims, 4 Drawing Sheets

BYPASS AIR INJECTION METHOD AND APPARATUS FOR GAS TURBINES

This application is a division of application Ser. No. 09/828,471, filed Apr. 9, 2001, now U.S. Pat. No. 6,449,956, the entire content of which is hereby incorporated by reference in this application.

The present invention relates to gas turbines, and more particularly, relates to a bypass air injection apparatus and method to increase the effectiveness of the combustor by quenching the combustion process.

BACKGROUND OF THE INVENTION

Gas turbine manufacturers are currently involved in research and engineering programs to produce new gas turbines that will operate at high efficiency without producing undesirable air polluting emissions. The primary air polluting emissions usually produced by gas turbines burning conventional hydrocarbon fuels are oxides of nitrogen, carbon monoxide and unburned hydrocarbons.

Catalytic reactors are generally used in gas turbines to control the amount of pollutants as a catalytic reactor burns a fuel and air mixture at lower temperatures, thus reduces pollutants released during combustion. As a catalytic reactor ages, the equivalence ratio (actual fuel/air ratio divided by the stochiometric fuel/air ratio for combustion) of the reactants traveling through the reactor needs to be increased in order to maximize the effectiveness of the reactor. Thus, there is a need to compensate for the degradation of the catalytic reactor.

BRIEF SUMMARY OF THE INVENTION

Accordingly, the present invention is directed to a bypass air injection apparatus and method to compensate for the degradation of a catalytic reactor and to increase combustor efficiency by extracting compressor discharge air prior to its entry into a combustion or reaction zone of the combustor, and re-injecting the extracted compressor discharge air into the combustor bypassing the catalytic reactor using a plurality of injection tubes located substantially in a common radial plane with an injection manifold. Compressor discharge air is received by the combustor in a first combustion chamber through a passageway, preferably an annulus defined between a combustor body with an inner liner and a casing enclosing the body. The first combustion chamber includes a pre-burner stage where fuel is mixed with compressor discharge air for combustion, thus raising the temperature of the hot gases sufficiently to sustain a reaction with the catalyst disposed downstream of the first combustion chamber. Hot gases flowing out of the first combustion chamber pass through a main fuel premixer (MFP) assembly for combustion in a main combustion chamber disposed downstream of the catalyst.

A predetermined amount of compressor discharge air, flowing through the annulus, and prior to reception in the first combustion chamber, is extracted into a manifold. The extraction manifold is disposed adjacent to an array of openings located in the casing enabling compressor discharge air to flow from the annulus into the extraction manifold. A bypass conduit connects the extraction manifold to an injection manifold. The injection manifold lies in communication with a plurality of injection tubes for injecting the extracted air into the combustor body bypassing the catalyst. As noted above, each injection tube and the injection manifold are disposed in a substantially common radial plane. Removable flange covers are provided on the injection manifold in substantial radial alignment with the respective injector tubes affording access to the tubes. The injection tubes are installed from the outside of the injection manifold at circumferentially spaced locations about the casing and the liner through flange covers. A bypass air (i.e., extracted air) path is therefore provided to bridge the backside cooling airflow annulus disposed between the combustor casing and the combustion liner.

In another embodiment, the combustor includes only one combustion chamber. Thus, the combustor is devoid of the catalyst and the MFP assembly. Here, main combustion occurs at the pre-burner stage where a greater amount of fuel is mixed with air in order for combustion to occur.

In one aspect, the present invention provides a combustor for a gas turbine having a combustor body; a casing enclosing the combustor body and defining an annular passageway therebetween for carrying compressor discharge air into the combustor body at one end thereof; a reaction zone within the combustor body for main combustion of fuel and air; a first annular manifold surrounding the casing and arranged to extract a predetermined amount of compressor discharge air from the annular passageway; a second annular manifold surrounding the casing and arranged to receive the extracted air, the second manifold located downstream of the first manifold in a combustion flow direction; a conduit for supplying the extracted air from the first manifold to the second manifold; and a plurality of injection tubes in communication with the second manifold for injecting the extracted air into the combustor body downstream of the reaction zone in the combustion flow direction to quench combustion, the injection tubes and the second manifold being disposed in a substantially common radial plane.

In another aspect, the present invention provides a combustor for a gas turbine including a combustor body with an inner liner; a casing enclosing the body and defining a passageway therebetween for carrying compressor discharge air; a catalytic reactor disposed in the body for controlling pollutants released during combustion; a first manifold for extracting a predetermined amount of compressor discharge air from the passageway; a second manifold for receiving the extracted air and supplying the extracted air to the body at a location bypassing the catalytic reactor; and a plurality of injection tubes in communication with the second manifold for injecting the extracted air into the body, the injection tubes and the second manifold being disposed in a substantially common radial plane.

In another aspect, the present invention provides a gas turbine having a compressor section for pressurizing air; a combustor for receiving the pressurized air; and a turbine section for receiving hot gases of combustion from the combustor, the combustor including a combustor body with an inner liner, a casing enclosing the body and defining a passageway therebetween for carrying compressor discharge air, a reaction zone within the combustor body for combustion of fuel and air, a first manifold surrounding the casing and arranged to exhaust a predetermined amount of compressor discharge air from the passageway, a second manifold surrounding the casing and arranged to receive the extracted air, the second manifold located downstream of the first manifold in a combustion flow direction; a conduit for supplying the extracted air from the first manifold to the second manifold; and a plurality of injection tubes in communication with the second manifold for injecting the extracted air into the combustor body downstream of the reaction zone in the combustion flow direction to quench combustion, the injection tubes and the second manifold are disposed in a substantially common radial plane.

In yet another aspect, the present invention provides a method for quenching combustion by extracting a predetermined amount of compressor discharge air, before the air flows into the reactor, from the passageway into the first manifold; supplying the extracted air from the first manifold to the second manifold via the conduit; injecting the extracted air received by the second manifold into the body at a location along the body bypassing the reactor using an array of injection tubes; and disposing the injection tubes and the second manifold in a substantially common plane.

DETAILED DESCRIPTION OF THE INVENTION

As is well known, a gas turbine includes a compressor section, a combustion section and a turbine section. The compressor section is driven by the turbine section typically through a common shaft connection. The combustion section typically includes a circular array of circumferentially spaced combustors. A fuel/air mixture is burned in each combustor to produce the hot energetic gas, which flows through a transition piece to the turbine section. For purposes of the present description, only one combustor is discussed and illustrated, it being appreciated that all of the other combustors arranged about the turbine are substantially identical to one another.

Figure 1:
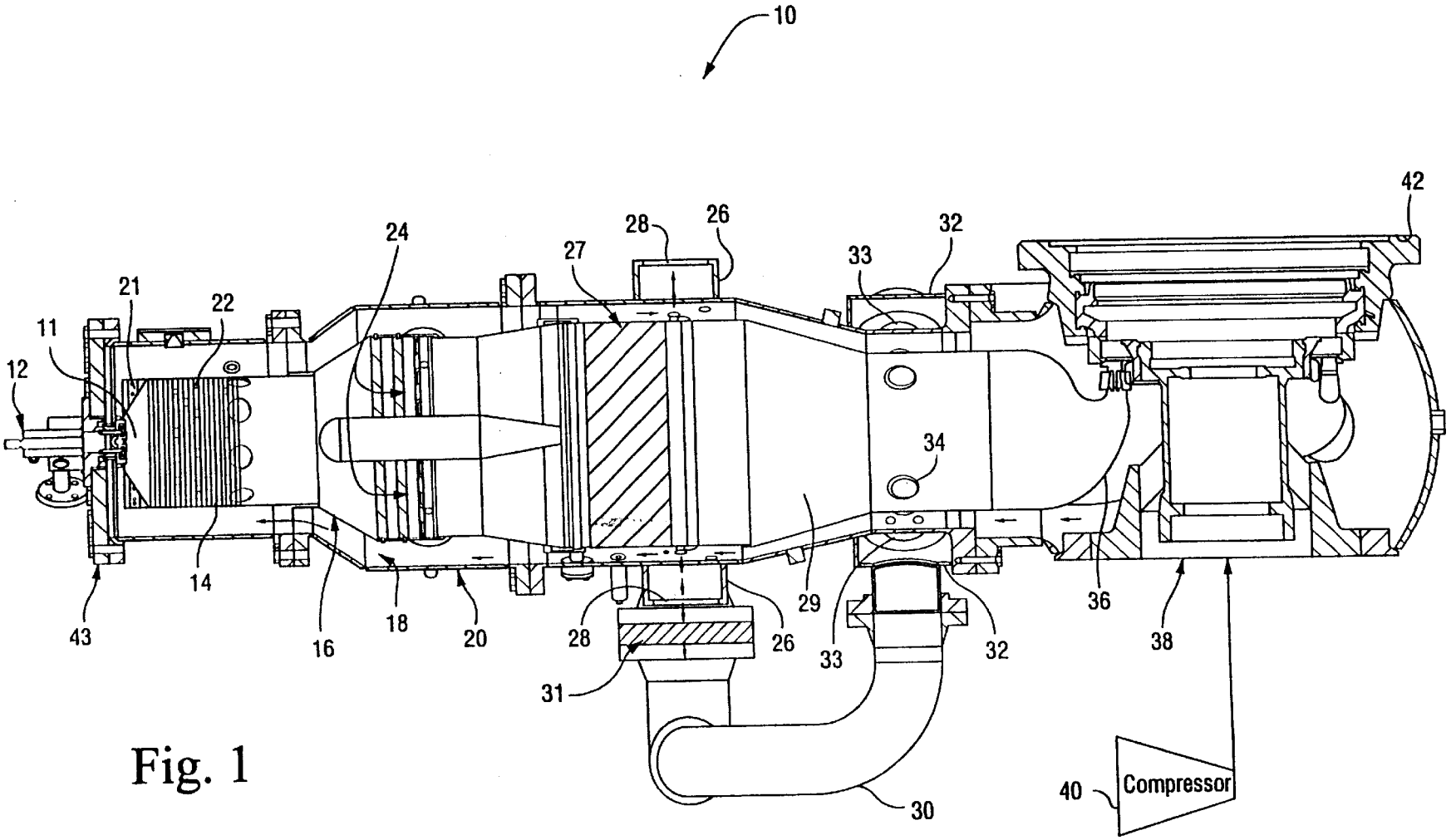
FIG. 1 is a schematic cross-sectional illustration of a combustor forming a part of a gas turbine and constructed in accordance with the present invention.

Referring now to FIG. 1, there is shown a combustor generally indicated at 10 for a gas turbine including a fuel injector assembly 12 having a single nozzle or a plurality of fuel nozzles (not shown), a cylindrical combustor body 16, and a casing 20 enclosing the body 16 thereby defining a passageway 18, preferably an annulus 18 therebetween. An ignition device (not shown) is provided and preferably comprises an electrically energized spark plug. Discharge air received from a compressor 40 via an inlet duct 38 flows through the annulus 18 and enters the body 16 through a plurality of holes 22 provided on the body 16. Compressor discharge air enters body 16 under a pressure differential across the cap assembly 21 to mix with fuel from the fuel injector assembly 12. The mixture is burnt by the pre-burner assembly 11. Combustion occurs in a first combustion chamber or first reaction zone 14 within the body 16 thus raising the temperature of the combustion gases to a sufficient level for the catalyst 27 to react. Combustion air from the first combustion chamber 14 flows through a main fuel premixer (MFP) assembly 24 and then through catalyst 27 into the main combustion chamber or main reaction zone 29 for combustion. Additional fuel is pumped into the MFP assembly to mix with hot gases, exiting the first combustion chamber 14, thus producing a combustion reaction in the main combustion chamber 29, whereby the hot gases of combustion pass through a transition piece 36 to drive the turbine (an inlet section of which is shown at 42).

Figure 2:
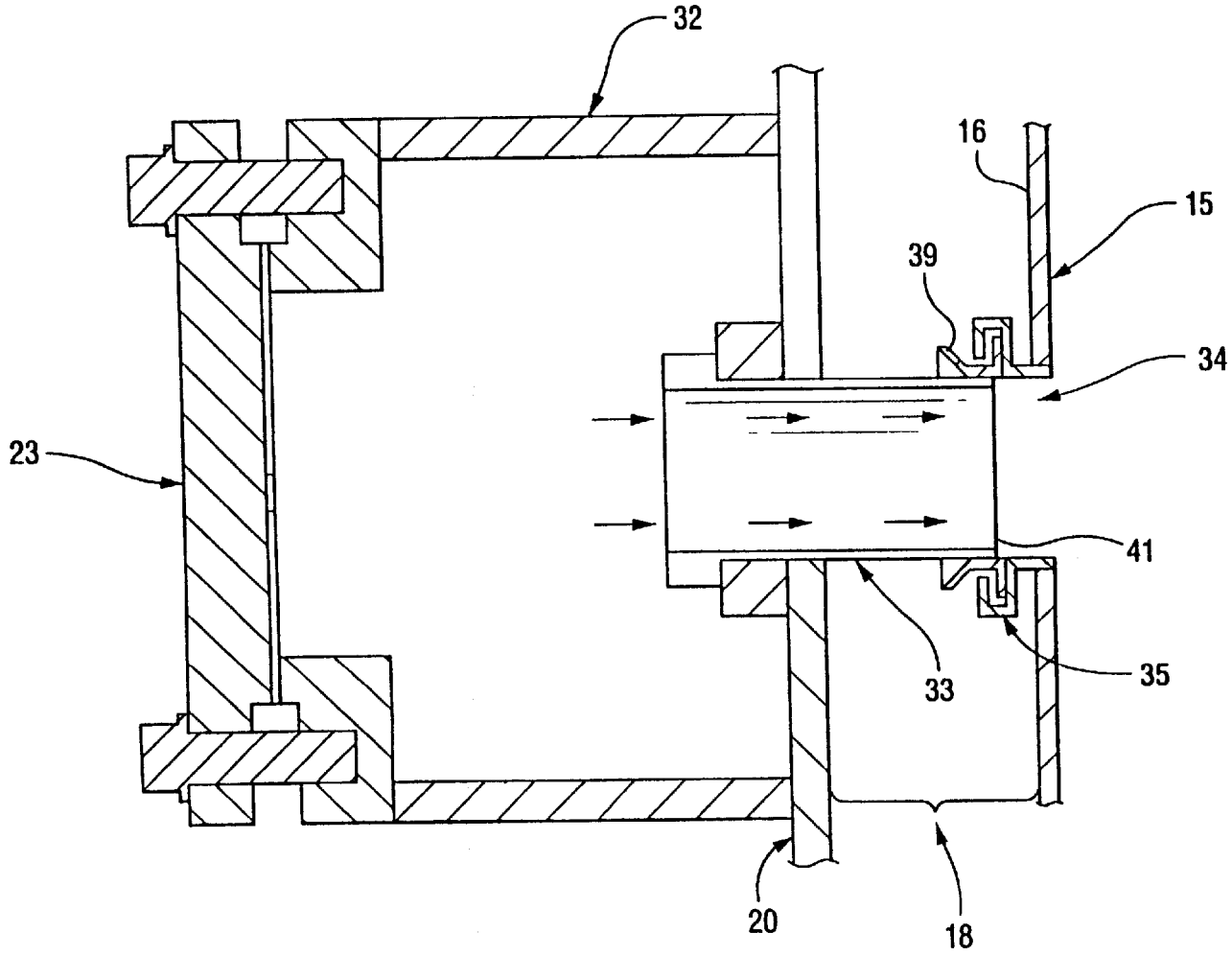
FIG. 2 is a detailed illustration of the injection manifold and the bypass injection scheme of the present invention.
Figure 4:
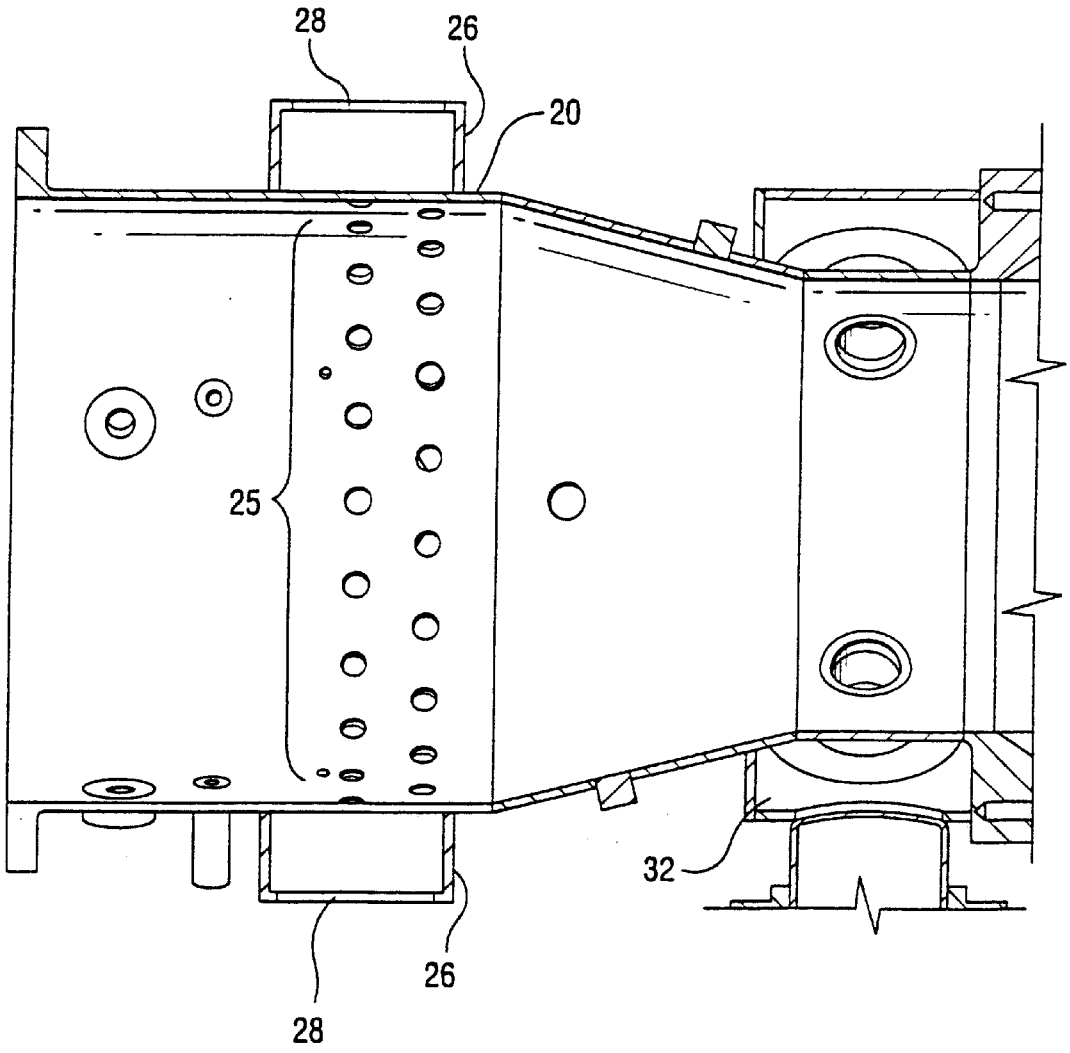
FIG. 4 shows a section of the combustor casing, of FIG. 1, having an array of openings for extracting compressor discharge air.

A predetermined amount of the compressor discharge air is extracted from the annulus 18 into a manifold 26 via an array of openings 25 (FIG. 4) located in casing 20 and leading into an opening 28 which sealingly mates with one end of a bypass conduit 30, while a second end of conduit 30 leads into an injection manifold 32. A valve 31 regulates the amount of air supplied to manifold 32. Air received in manifold 32 is injected by a plurality of injection tubes 33 into body 16, bypassing catalyst 27. Each of the injection tubes 33 and manifold 32 are located substantially in a common [axial] radial plane. Further, each injection tube opens into body 16 through apertures 34 (FIG. 2). Removable flange covers 23 are provided on the injection manifold in substantial radial alignment with the respective injector tubes 33 affording access to the tubes. The injection tubes are installed from the outside of the injection manifold at circumferentially spaced locations about the casing and the liner through flange covers. Members 35 and 39 (FIG. 2) cooperate to secure each injection tube 33 to body 16 in a floating seal to provide a sealingly tight connection. Thus, injected air cools the reaction and quenches the combustion process.

Figure 3:
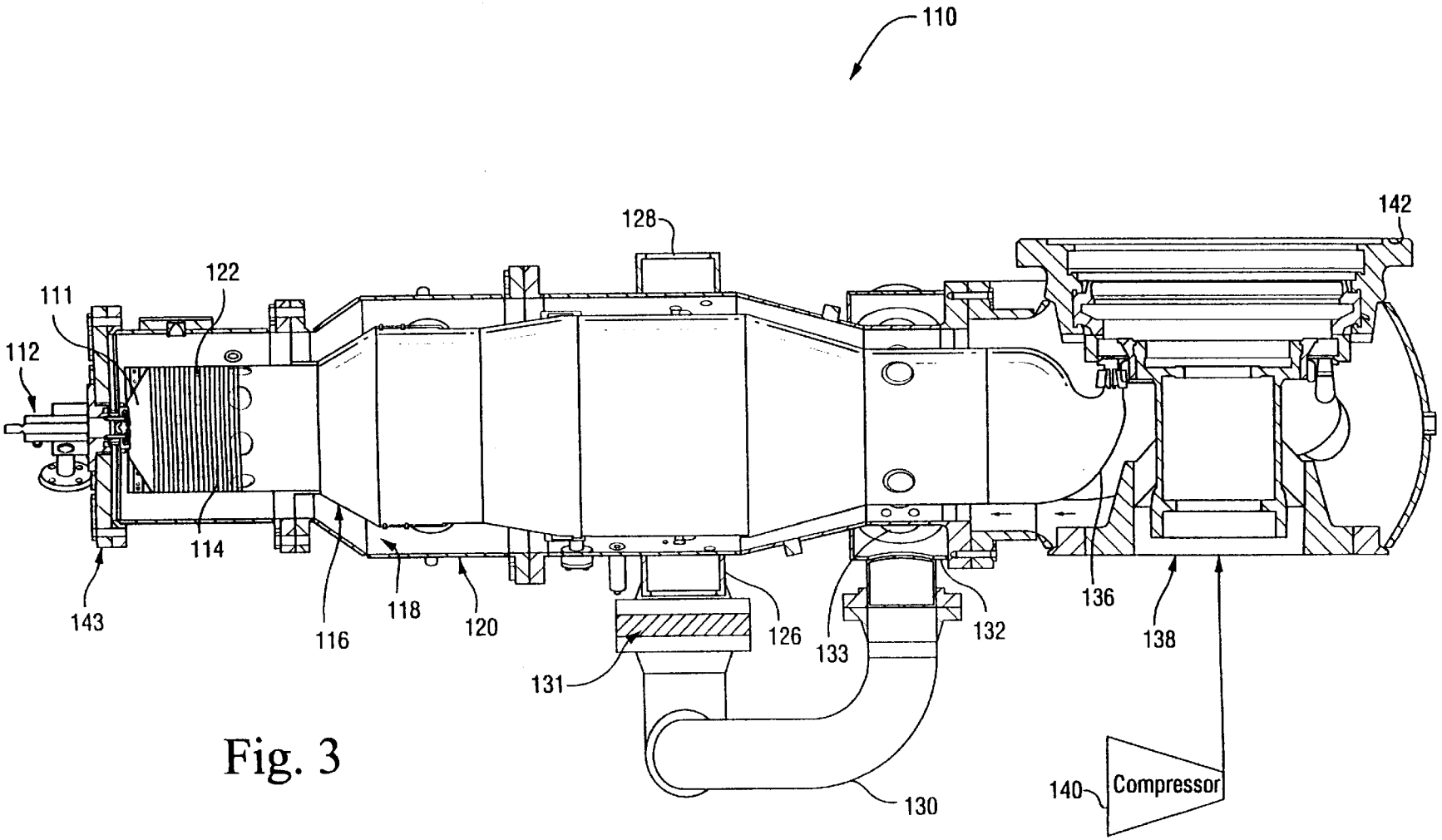
FIG. 3 illustrates another embodiment of the invention wherein a catalytic reactor is removed from the combustor.

Referring to FIG. 3, a second embodiment is illustrated wherein like elements as in the combustor of FIG. 1 are indicated by like reference numerals preceded by the prefix "1". Here, the combustor 110 comprises a combustion chamber or reaction zone 114 where main combustion occurs. Catalyst 27 and MFP assembly 24 are absent in this embodiment. Here, compressor discharge air from annulus 118 flows into manifold 126, and from manifold 126 via conduit 130 flows into body 116 through injection tubes 133 bypassing the reaction zone 114. Further, the amount of fuel supplied to mix with compressor discharge air is greater than the amount supplied in the presence of a catalyst. It will be appreciated that the location of the reaction zone 114 need not necessarily lie in close proximity to the fuel injector assembly 112. Rather it may be located within body 116 between end member 143 and manifold 132. Likewise, manifold 132 may be appropriately located along casing 120 to inject air into body 116 provided the reaction zone is bypassed in order to quench the combustion process. In other words, the manifold 132 and the injection of compressor discharge air into combustor body occurs downstream of the reaction zone 114 in a combustion flow direction, as apparent from FIG. 3.

Thus, the present invention has the advantages of maximizing the effectiveness of the catalytic reaction, thereby increasing the efficiency of the combustor. The present invention further provides a simple means of controlling the combustion process.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a gas turbine, comprising:

a combustor body;

a casing enclosing said combustor body and defining an annular passageway therebetween for carrying compressor discharge air into said combustor body at one end thereof;

a reaction zone within said combustor body for main combustion of fuel and air;

a first annular manifold surrounding said casing and arranged to extract a predetermined amount of compressor discharge air from said annular passageway;

a second annular manifold surrounding said casing manifold and arranged to receive the extracted air, said second manifold located downstream of said first manifold in a combustion flow direction;

a conduit for supplying the extracted air from said first manifold to said second manifold; and a plurality of injection tubes in communication with said second manifold for injecting the extracted air into said combustor body downstream of said reaction zone in the combustion flow direction to quench combustion, said injection tubes and said second manifold being disposed in a substantially common radial plane.

2. The combustor of claim 1, further comprising:

an array of openings disposed in said casing to permit the compressor discharge air to flow through said openings into said first manifold; and a conduit for supplying the extracted air from said first manifold to said second manifold.

3. The combustor of claim 2, wherein said second manifold includes an access flange for each injection tube.

4. The combustor of claim 3, wherein the injection tubes are equally spaced from one another about said second manifold.

5. The combustor of claim 1, wherein said conduit includes a control valve to regulate air flowing from said first manifold to said second manifold.

6. A gas turbine comprising:

a compressor section for pressurizing air;

a combustor for receiving the pressurized air; and turbine section for receiving hot gases of combustion from the combustor, said combustor including a combustor body with an inner liner, a casing enclosing said body and defining a passageway therebetween for carrying compressor discharge air, a reaction zone within said combustor body for combustion of fuel and air, a first manifold surrounding said casing and arranged to extract a predetermined amount of compressor discharge air from said passageway, a second manifold surrounding said casing and arranged to receive the extracted air, said second manifold located downstream of said first manifold in a combustion flow direction; a conduit for supplying the extracted air from said first manifold to said second manifold, and a plurality of injection tubes in communication with said second manifold for injecting the extracted air into said combustor body downstream of said reaction zone in the combustion flow direction to quench combustion, said injection tubes and said second manifold being disposed in a substantially common radial plane.

7. A gas turbine according to claim 6, wherein said casing further includes an array of openings adjacent to said first manifold to enable the compressor discharge air to flow through said openings into said first manifold.

8. The gas turbine of claim 7, wherein said second manifold includes an access flange for each injection tube.

9. The gas turbine of claim 8, wherein the injection tubes are equally spaced from one another about said second manifold.

* * * * *